US009395090B2

(12) United States Patent
Corleoni et al.

(10) Patent No.: US 9,395,090 B2
(45) Date of Patent: Jul. 19, 2016

(54) SUCTION HOOD

(75) Inventors: Francesco Corleoni, Meldola (IT); Cedric Damien Catalogne, Torreano di Martignacco (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 839 days.

(21) Appl. No.: 13/132,348

(22) PCT Filed: Dec. 10, 2009

(86) PCT No.: PCT/EP2009/008825

§ 371 (c)(1),
(2), (4) Date: Jun. 2, 2011

(87) PCT Pub. No.: WO2010/066423

PCT Pub. Date: Jun. 17, 2010

(65) Prior Publication Data

US 2011/0240004 A1 Oct. 6, 2011

(30) Foreign Application Priority Data

Dec. 10, 2008 (EP) ..... 08021414
Dec. 10, 2008 (EP) ..... 08021415
Jun. 12, 2009 (EP) ..... 09007739

(51) Int. Cl.
*F24C 15/20* (2006.01)

(52) U.S. Cl.
CPC ..... *F24C 15/20* (2013.01)

(58) Field of Classification Search
CPC ..... F24C 15/20
USPC ..... 126/299 R
See application file for complete search history.

(56) References Cited

U.S. PATENT DOCUMENTS 2,783,702 A * 3/1957 O'Day ..... F24F 13/142 454/333
3,205,810 A * 9/1965 Rosenak ..... 454/64
3,332,676 A * 7/1967 Namy ..... 266/89
4,062,274 A * 12/1977 Knab ..... 454/65
4,596,382 A * 6/1986 Lazcano-Navarro et al. 266/158
4,785,722 A * 11/1988 Dollhopf et al. ..... 454/62
6,290,899 B1 * 9/2001 Then ..... 266/158
6,551,185 B1 * 4/2003 Miyake et al. ..... 454/234
6,620,038 B1 * 9/2003 Kikuchi ..... F24F 7/06 126/299 D
6,632,132 B1 * 10/2003 Kikuchi et al. ..... 454/66
7,601,054 B2 * 10/2009 Bagwell et al. ..... 454/49
2005/0169792 A1 * 8/2005 Abehssera ..... 422/5
2006/0032492 A1 * 2/2006 Bagwell ..... F15D 1/02 126/299 R
2006/0278216 A1 * 12/2006 Gagas ..... F24C 15/2028 126/299 D
2009/0032011 A1 * 2/2009 Livchak et al. ..... 126/299 D

FOREIGN PATENT DOCUMENTS

WO 8911926 12/1989
WO WO 2006012628 A2 * 2/2006

* cited by examiner

*Primary Examiner* — Avinash Savani
*Assistant Examiner* — Deepak Deean
(74) *Attorney, Agent, or Firm* — Pearne & Gordon LLP

(57) ABSTRACT

The invention relates to a suction hood (3, 4, 5), preferably vortex hood or tornado hood, a) comprising a vortex generator (33, 43, 53) for generating a vortex air stream (336, 436, 536), b) wherein the vortex air stream comprises an at least substantially circular, cyclone, vortex and/or helix like air movement, c) such that fumes or smoke can be pulled into the suction hood (3, 4, 5) by the vortex air stream, d) comprising stabilizing means (32, 433, 54) for improving the stability of the vortex air stream.

16 Claims, 7 Drawing Sheets

SUCTION HOOD

The invention relates to a suction hood, preferably a vortex generator or tornado suction means.

Known or traditional suction hoods, which also can be denominated as destructor hoods, range hoods, kitchen hoods, stove hoods, exhaust hoods, cooker hoods, extraction hoods, cooking canopy or ventilation hoods, are used to remove airborne grease, combustion products, smoke, odours and/or heat and steam, which is generated usually by a cooking process on a cooktop, normally by a combination of filtration and evacuation of the air. They usually comprise three main components: A skirt or capture panel to contain the rising gases (also known as the "effluent plume"), one or more grease filters, and a fan or tangential blower for forced ventilation.

The fans or blowers create, when activated, an area of low pressure which takes effect spherically around the hood.

The airborne grease, combustion products, smoke, odours, heat and steam generated by the cooking of food on the cooktop rise naturally in a vertical motion due to gravity effect, and enter the effective area of the hood to be captured by the low pressure area.

Figure 1A:
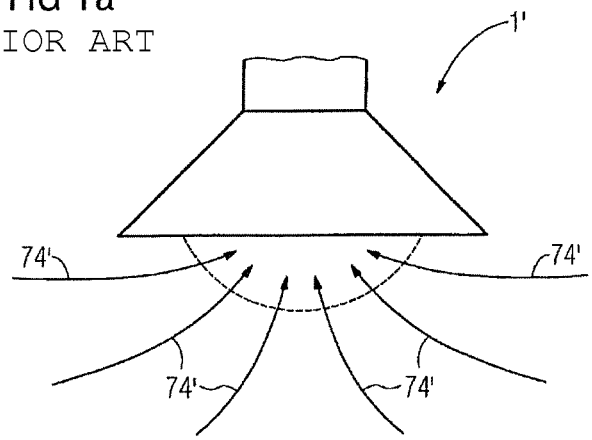
FIG 1a PRIOR ART

The traditional hoods as described above present at least relatively low efficiency in treating the fumes from the cooktop as they suck-up equally air from the surrounding environment. FIG. 1*a* shows such a hood 1', where the gas is sucked in from all sides along paths shown by arrows 74'.

Figure 1B:
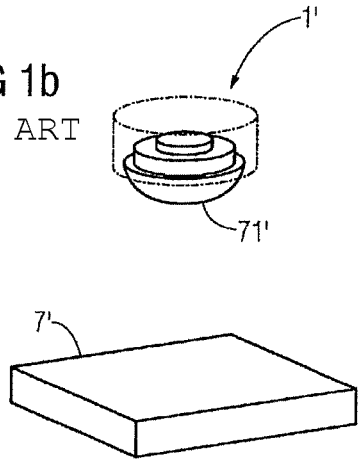
FIG 1b PRIOR ART

The pressure field 71' of a traditional hood 1' over a cooktop 7' is shown in FIG. 1*b*. The pressure field represents the effective suction volume of the hood.

In WO 89/11926 A1, a ventilating system has been proposed with nozzles and/or blowers mounted around one or more centrally located exhaust channels.

In is an object of invention, to improve the characteristics of the suction means and the hood, especially the suction characteristics, preferably in a cost-effective way.

This object is solved by a suction hood according to claim 1. Advantageous embodiments can be derived especially from the dependent claims.

According to claim 1, the invention relates to a suction hood, preferably a vortex hood or tornado hood, a) comprising a vortex generator for generating a vortex air stream,
b) wherein the vortex air stream comprises an at least substantially circular, cyclone, vortex and/or helix like air movement,
c) such that fumes or smoke can be pulled into the suction hood by the vortex air stream, characterized by d) stabilizing means for improving the stability of the vortex air stream.

An improved stability of the vortex air stream makes it possible to pull in the fumes in a more effective way. A vortex air stream with an improved stability is normally a vortex air stream which has a shape below the vortex generator which is extending as far as possible downwards and which is as close as possible to a cylindrical form.

Preferably, the vortex air stream is stable over time, wherein the vortex air stream especially does not dwindle to reappear again and/or its position does not move over time. However, there is preferably, especially dependent on the distance from the vortex generator, a point of rupture where the vortex air stream disappears or disperses. Improving the stability of the vortex air stream therefore preferably means that the distance after which the vortex air stream disappears is made as long as possible.

Preferably, the suction hood comprises a suction channel and/or a diffuser, wherein preferably the suction channel is arranged above the diffuser, wherein preferably the diffuser is arranged above the vortex generator and/or between the suction channel to and the vortex generator, so that the diffuser adapts the cross section of the vortex generator to the cross section of the suction channel. In this case, it is possible that the suction channel has a smaller cross section than the vortex generator, so that the vortex generator can preferably be operated with a cross section which corresponds to at least part of the area to be sucked, especially the cooking area, whereas the suction channel can preferably be operated with an at least relatively small cross section so that the necessary space and costs are minimized or reduced.

Preferably, the vortex air stream rotates around an axis and/or the vortex generator is arranged around an or the axis and/or the stabilizing means tilts the axis of the vortex generator and/or the vortex air stream with respect to a vertical direction, such that especially, in case the suction hood is mounted at a wall, the vortex air stream is or can be directed away from the wall. This embodiment can especially be used when the suction hood is mounted in front of a wall as it can reduce the effects of the wall and improve the vortex stability, as the vortex air stream can be deformed, in case it is arranged too close to a wall.

Preferably, the stabilizing means is the or a diffuser, on which the vortex generator is or can be attached, wherein the diffuser comprises an inclined bottom side, so that the vortex generator is or can be hold in an inclined position and/or the stabilizing means is an intermediate part between the diffuser and the vortex generator, wherein the upper side of the intermediate part is inclined with respect to the bottom side, so that the vortex generator is hold in an inclined position and/or the stabilizing means is implemented by an inclined upper side of the vortex generator, so that the vortex generator is hold in an inclined position.

Preferably, the stabilizing means is a, preferably ring shaped, skirt for at least partially surrounding the vortex air stream and/or for at least partially surrounding the inner surface of the vortex generator, wherein for improving the stability of the vortex air stream or for activating the vortex air stream, the skirt can be shifted down from a first position to a second position, wherein in the first position, the skirt is arranged at least substantially inside the vortex generator, wherein in the second position, the skirt is arranged at least substantially below the vortex generator so that the vortex generator is extended downwards, wherein preferably the skirt is slidably fixed along the inner surface of the vortex generator. This embodiment enlarges the area in which the vortex air stream is guided so that it can maintain its stability at least down to an area which is further downwards with respect to the suction hood.

Preferably, the stabilizing means are suction means, by which laterally and/or vertically sucked air towards the suction hood can be generated at least partially around the vortex air stream, so that the radial losses of the vortex generator are reduced, wherein the suction means preferably sucks with a low suction volume, wherein preferably the suction means is attached at the suction channel, so that the laterally sucked air is or can be mixed with the vortex air stream. Also this embodiment reduces the diffusion of the vortex air stream so that its stability is enhanced.

Preferably, the suction hood is designed as a vented hood, which is preferably connected to a duct system for extracting the sucked air out of a room, especially a kitchen, and/or the suction hood is designed as a recirculating hood, wherein it preferably comprises a filter, especially an activated charcoal filter, preferably to remove odour and smoke particles from the air, wherein the suction hood, after sucking in the air from a room, especially a kitchen, blows the preferably cleaned air back into the room again.

Preferably, the vortex generator comprises an at least substantially cylindrical interior and/or lateral openings towards the substantially cylindrical interior for guiding the air with a tangential component with respect to the cylindrical interior and/or fans or blowers for blowing air into the lateral openings.

Preferably, the suction hood comprises means which can generate an at least substantially horizontal air stream and/or the suction hood can be operated with the at least substantially horizontal air stream and/or with the vortex air stream.

Figure 1C:
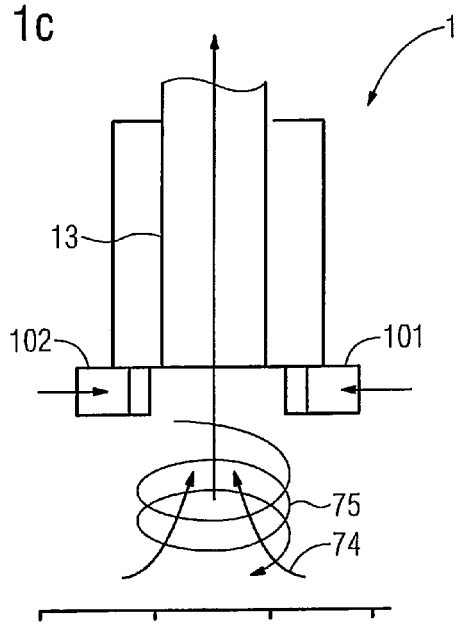
Figure 1D:
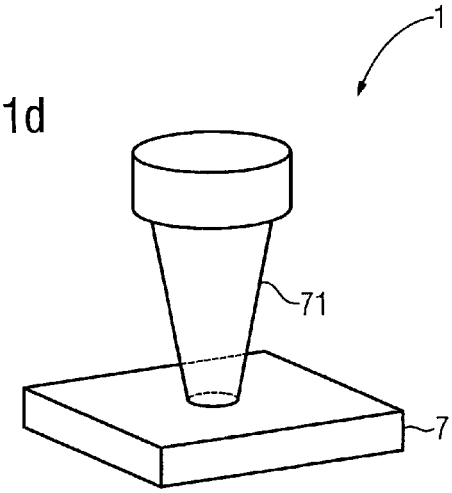
Figure 2:
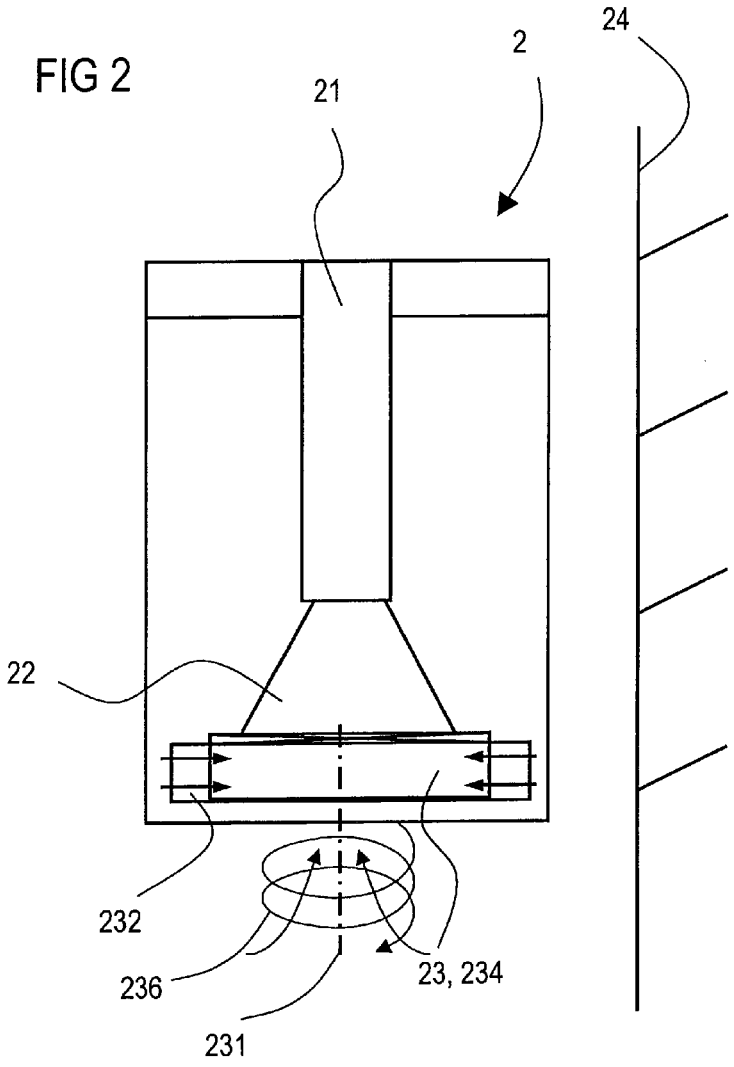
Figure 3:
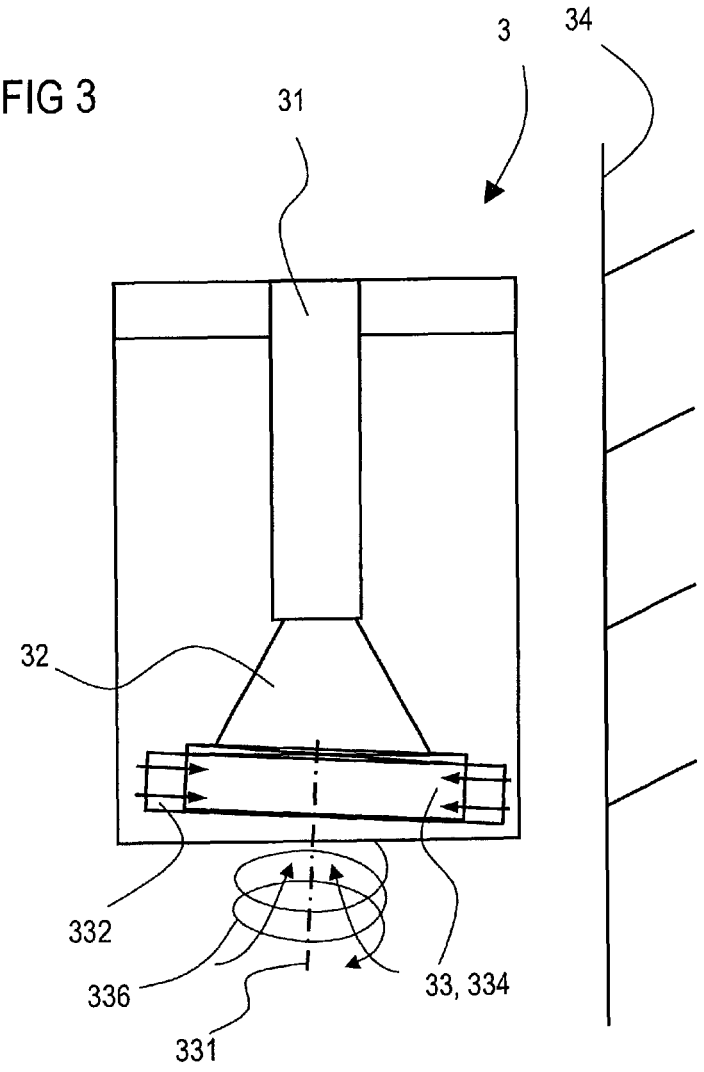
Figure 4:
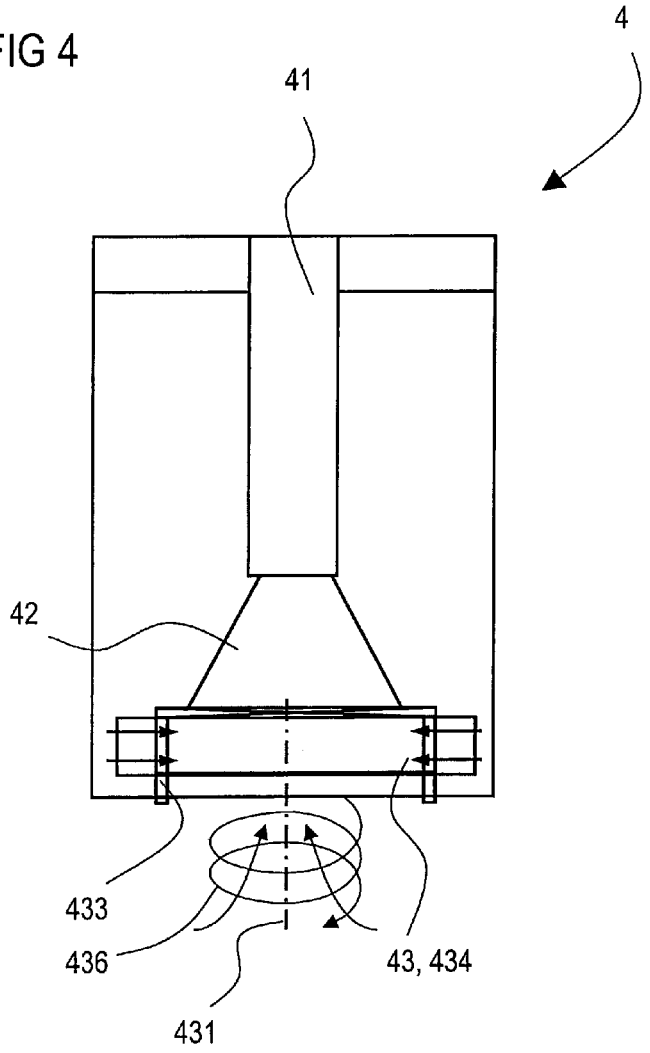
Figure 5:
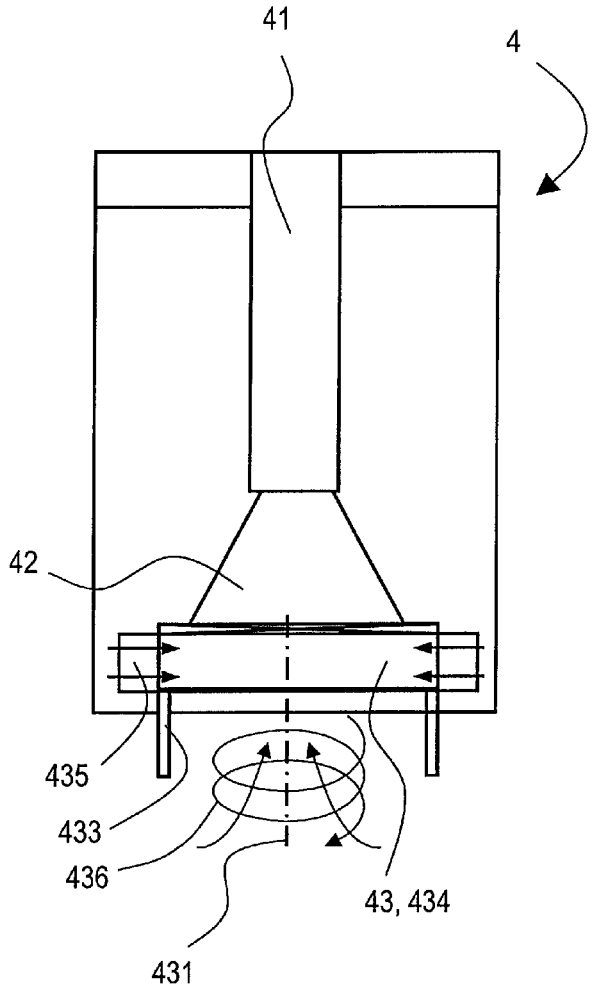
Figure 6:
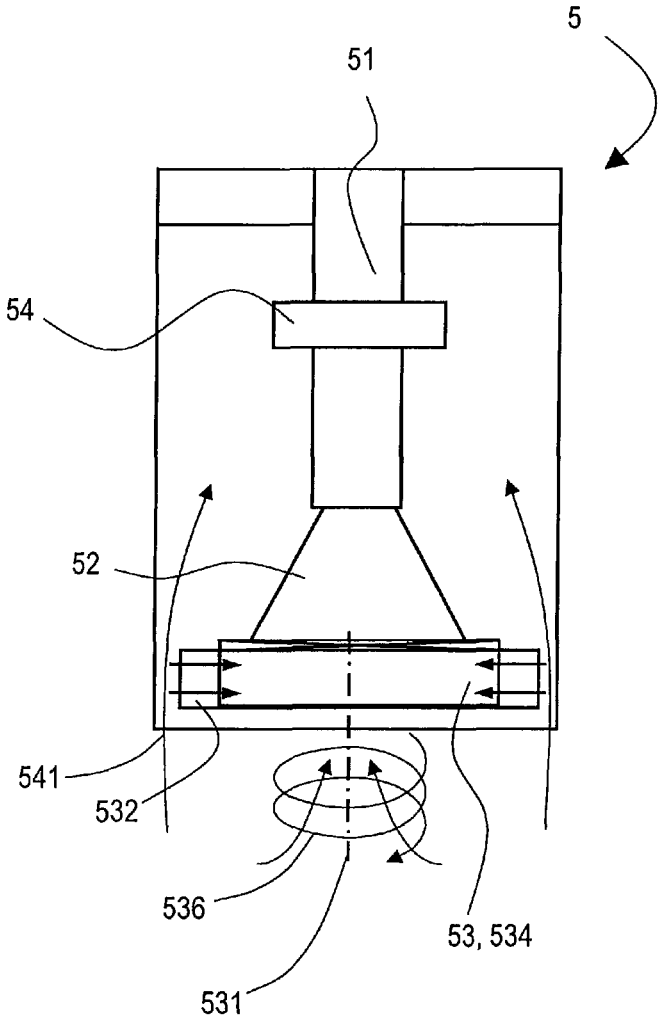

The invention will now be described in further details with references to the schematic figures, in which FIG. 1*a*, 1*b* show conventional hoods, as described above, FIG. 1*c* outlines the concept of a tornado suction hood, FIG. 1*d* shows the pressure field of a hood system according to FIG. 1*c*, FIG. 2 shows a suction hood according to the invention with a tiltable vortex generator in an untilted position, FIG. 3 shows a suction hood according to the invention with a tiltable vortex generator in a tilted position, FIG. 4 shows a suction hood with a movable skirt according to the invention in a first position, FIG. 5 shows the suction hood with a movable skirt according to the invention in a second position and in which FIG. 6 shows a suction hood with lateral suction means according to the invention.

FIG. 1*c* outlines the concept of a tornado suction hood 1. The arrows 75 represent the rotating column of air and the arrows 74 represent the suction draft. The combination of these two flows generates the tornado. The air is sucked in through air inlets 101, 102 and therefore pushed into the suction channel 13.

The pressure field 71 of such a hood system 1 is shown in FIG. 1*d*. The pressure field represents the effective suction volume of the hood. The generated vortex between the cooktop 7 and the hood 1 sucks in the fume from the cooktop 7 in a swirling motion.

FIG. 2 and FIG. 3 show a suction hood 2, 3 with a cylindric upper part 21, 31 as suction channel and a conical lower part 22, 32 as diffuser, on whose bottom a vortex generator 23, 33 is mounted. The diffuser adapts the diameter of the vortex channel to the diameter of the suction channel.

The vortex generator 23, 33 sucks in air from the side and blows it with a tangential component into the interior 234, 334 of the vortex generator, so that a vortex is formed in the interior 234, 334 which continues downwards as a vortex air stream 236, 336 around an axis 231, 331.

FIG. 3 shows a conical lower part 32 with an inclined bottom surface, on which the vortex generator 33 is mounted. By mounting on the inclined bottom surface of the conical lower part 32, the vortex generator 33 is tilted, which is shown in FIG. 3, and therefore, also the axis 331 of the vortex air stream 331 is tilted. The suction hood 3 is mounted next to a wall 34. When the vortex generator 33 is tilted, the effect of the wall 34 is reduced and therefore the stability of vortex is improved. Therefore, the conical lower part 32 works, in this embodiment, as a stabilizing means for the vortex generator 33, as the vortex generator is or can be hold in an inclined position.

As an alternative, the stabilizing means can be an intermediate part between the diffuser and the vortex generator, wherein the upper side of the intermediate part is inclined with respect to the bottom side, so that the vortex generator is hold in an inclined position.

As a further alternative, the stabilizing means is implemented by an inclined upper side of the vortex generator, so that the vortex generator is hold in an inclined position. Furthermore, a pivoting mechanism can be installed between the suction channel 31 and the vortex generator 33 so that the inclination of the vortex generator 33 can be adjusted as desired.

FIG. 4 and FIG. 5 show a suction hood 4 with a vortex generator 43. Again, the suction hood comprises a cylindric upper part 41 and a conical lower part 42, on whose bottom a vortex generator 43 is mounted.

The vortex generator 43 sucks in air from the side and blows it with a tangential component into the interior 434 of the vortex generator, so that a vortex is formed in the interior 434 which continues downwards as a vortex air stream 436 around an axis 431.

In this embodiment, the stabilizing means is implemented as a skirt 433 which has a ring shaped form and which surrounds the inner surface of the vortex generator 43 and which surrounds the vortex air stream 436 in its upper portion.

For improving the stability of the vortex air stream, the skirt 433 can be shifted down from a first, upper position to a second, lower position.

In the first position, which is shown in FIG. 4, the skirt 433 is arranged substantially inside the vortex generator 43.

In the second position, which is shown in FIG. 5, the skirt 433 is arranged mostly below the vortex generator 43 so that the vortex generator 43 is extended downwards. This extension enlarges the cylindrical part of the suction area so that a vortex air stream 436 with higher stability can be formed.

As an alternative, the vortex generation can be blocked in the first position, as the lateral openings towards the substantially cylindrical interior for guiding the air with a tangential component with respect to the cylindrical interior can be blocked by the skirt 433. In this case, a horizontal air stream can be generated inside the suction channel 41 which sucks the air directly into the suction channel.

FIG. 6 shows another embodiment wherein the stabilizing means 54 are suction means, by which a lateral suction 541 towards the suction hood 5 can be generated around the vortex air stream 536, so that the radial losses of the vortex generator 536 are reduced. The suction means 54 sucks with a low suction volume.

By reducing the radial losses, the lateral suction 541 also improves the stability of the vortex.

The suction hood in the shown embodiments is a vented hood, which is preferably connected to a duct system for extracting the sucked air out of a room, especially a kitchen.

As an alternative or in addition, the suction hood can also be a recirculating hood, preferably with a filter, especially an activated charcoal filter, wherein the suction hood sucks the air in from the room air, especially in a kitchen, and blows the air back into the room again.

The vortex generator comprises an at least substantially cylindrical interior and lateral openings towards the substantially cylindrical interior for guiding the air with a tangential component with respect to the cylindrical interior and fans or blowers for blowing air into the lateral openings.

The vortex air stream is stable over time. This means that the vortex air stream does not dwindle to reappear again and that its position does not move over time. However, there is, dependent on the distance from the vortex generator, a point of rupture where the vortex air stream disappears or disperses. Improving the stability of the vortex air stream therefore means that the distance after which the vortex air stream disappears is made as long as possible.

The suction hood can comprise, which is not shown in the figures, means which can generate an at least substantially horizontal air stream. In this case, the suction hood can be operated with the at least substantially horizontal air stream and/or with the vortex air stream.

REFERENCE SIGNS

1, 2, 4, 5 suction hoods
21, 41, 51 suction channels
22, 42, 52 diffusers
23, 43, 53 vortex generators
231, 431, 531 axis
541 lateral suction area
234, 434, 534 vortex interior area
236, 436, 536 vortex air stream
24, 34 wall
433 skirt
7, 7' cooktops
71, 71' pressure fields
74, 75, 74' air movement

The invention claimed is:

1. A suction hood comprising:

a vortex generator configured to generate a vortex air stream, wherein the vortex air stream comprises an at least substantially circular, cyclone, vortex and/or helix like air movement, such that fumes or smoke can be pulled into the suction hood by the vortex air stream from an area below the suction hood toward the vortex generator through a suction area of the vortex generator, and wherein the suction area of the vortex generator comprises an inner surface and a moveable skirt arranged at the inner surface, wherein the inner surface and the moveable skirt form a boundary of an opening in the suction hood in which the vortex air stream is generated and through which the fumes or smoke can be pulled, and wherein the inner surface comprises a cylindrical interior comprising lateral openings for guiding air with a tangential component with respect to the cylindrical interior, and wherein the moveable skirt is configured to be shifted down from a first position to a second position, wherein in the first position, the moveable skirt is arranged inside the vortex generator to block the lateral openings, and wherein in the second position, the moveable skirt is arranged below the vortex generator to extend the suction area of the vortex generator and the boundary of the opening in the suction hood downward away from the vortex generator for improving the stability of the vortex air stream.

2. The suction hood according to claim 1 further comprising:

a suction channel and a diffuser, wherein the suction channel is arranged above the diffuser and wherein the diffuser is arranged above the vortex generator and between the suction channel and the vortex generator, so that the diffuser adapts a cross section of the vortex generator to a cross section of the suction channel.

3. The suction hood according to claim 1, wherein the vortex air stream rotates around an axis and wherein the vortex generator is arranged around the axis, wherein the axis of the vortex generator and the vortex air stream is configured to be tilted with respect to a vertical direction such that, in case the suction hood is mounted at a wall the vortex air stream can be directed away from the wall.

4. The suction hood according to claim 3, further comprising:

a diffuser, on which the vortex generator is or can be attached, wherein the diffuser comprises an inclined bottom side, so that the vortex generator is or can be held in an inclined position to tilt the axis with respect to the vertical direction and/or an intermediate part between the diffuser and the vortex generator, wherein an upper side of the intermediate part is inclined with respect to the bottom side, so that the vortex generator is held in an inclined position to tilt the axis with respect to the vertical direction and/or an inclined upper side of the vortex generator, so that the vortex generator is held in an inclined position to tilt the axis with respect to the vertical direction.

5. The suction hood according to claim 1, further comprising: suction means by which laterally and/or vertically sucked air towards the suction hood can be generated at least partially around the vortex air stream when the moveable skirt is in the second position, so that the radial losses of the vortex generator are reduced.

6. The suction hood according to claim 5, wherein the suction means sucks with a low suction volume and/or the suction means is attached at a suction channel so that the laterally sucked air is mixed with the vortex air stream.

7. The suction hood according to claim 1, wherein the suction hood is a vented hood, which is connected to a duct system for extracting air out of a room or wherein the suction hood is a recirculating hood, wherein the suction hood sucks air in from a room and blows the air back into the room again.

8. The suction hood according to claim 1, wherein the inner surface comprises a cylindrical interior comprising lateral openings for guiding air with a tangential component with respect to the cylindrical interior.

9. The suction hood according to claim 1, wherein the moveable skirt is ring shaped.

10. The suction hood according to claim 1, wherein the moveable skirt is slidably fixed along the inner surface of the vortex generator.

11. The suction hood according to claim 1, wherein in the first position, the skirt is arranged inside the suction hood, and wherein in the second position, the skirt extends below the suction hood.

12. The suction hood according to claim 1, wherein the vortex air stream rotates about an axis, and the inner surface of the suction area is vertically oriented with respect to the axis.

13. The suction hood according to claim 12, wherein the moveable skirt is vertically oriented with respect to the axis.

14. The suction hood according to claim 1, wherein the vortex air stream comprises a rotating column of air and a suction draft.

15. The suction hood according to claim 14, wherein the rotating column of air rotates within the boundary.

16. The suction hood according to claim 15, wherein the suction draft travels upward from the area below the suction hood toward the vortex generator through the boundary.

* * * * *